US005244298A

United States Patent [19]

Greenhouse

[11] Patent Number: 5,244,298

[45] Date of Patent: Sep. 14, 1993

[54] TOOTHBRUSH

[76] Inventor: Albert M. Greenhouse, 355 Southend Ave.-Apt. 29J, New York, N.Y. 10280

[21] Appl. No.: 964,195

[22] Filed: Oct. 21, 1992

[51] Int. Cl.[5] ..... A46B 11/02

[52] U.S. Cl. ..... 401/191; 401/123; 401/269

[58] Field of Search ..... 401/123, 124, 125, 191, 401/269; 132/308

[56] References Cited

U.S. PATENT DOCUMENTS

| | | | |
|---|---|---|---|
| 1,270,512 | 6/1918 | Greaza | 132/308 |
| 1,423,405 | 7/1922 | Dayeh | 401/124 |
| 1,644,049 | 10/1927 | Young | 132/308 |
| 2,065,641 | 12/1936 | Bouchard | 401/191 |
| 2,445,571 | 7/1948 | Fuston | 401/191 X |
| 2,562,937 | 8/1951 | Moricich . | |
| 2,583,631 | 1/1952 | Chehak . | |
| 2,756,450 | 7/1956 | Stolarevsky | 401/191 |
| 2,785,832 | 3/1957 | Verban . | |
| 2,813,290 | 11/1957 | Aschenbach . | |
| 3,549,268 | 12/1970 | Casselman . | |
| 3,816,007 | 6/1974 | Fox . | |
| 4,332,497 | 6/1982 | Rodriguez . | |
| 4,615,635 | 10/1986 | Kim . | |
| 5,028,158 | 7/1991 | Fey . | |

*Primary Examiner*—Steven A. Bratlie
*Attorney, Agent, or Firm*—Stanley J. Yavner

[57] ABSTRACT

An elongated housing structure is provided for accommodating a toothbrush head at one of its ends, and for insertion of a tube of toothpaste through the other of its ends. A rotating pin is provided to roll the bottom end of the toothpaste tube, thereby to dispense the toothpaste, and to move forwardly of the housing as the tube becomes smaller and smaller when the toothpaste is dispensed. The forward motion of the pin is accommodated by an elongated slot defined by the housing. A further structural provision is made in order to selectively move the top of the toothpaste tube into and out of position with respect to the bristles of the toothbrush, by means of a knurled knob and depending collar or neck holder movable in a second slot defined by the housing. The toothbrush head is movably connected to the front of the housing, so that the bristles can be moved between a paste-loading position and a brushing position. A gripping surface is also defined by the housing. A connecting structure is provided to coordinate the motion of the tube positioning mechanism and the bristle-moving mechanism.

10 Claims, 3 Drawing Sheets

20
51
56
52
4
4
54
60
26
24
61
46
40
10
7
7
35
31
20'
39
30
32
20
70
60
56
54
52
51
26
24
27
72
36
20"
46
40
61
50
38
27
41
46
42

TOOTHBRUSH

FIELD OF THE INVENTION

This invention relates primarily to toothbrushes and more particularly to a toothbrush-toothpaste tube combination structure.

DESCRIPTION OF THE PRIOR ART AND BACKGROUND OF THE INVENTION

Of course, for many years persons have placed at the top of their hygiene requirement list the use of implements for brushing their teeth. In point of fact, based upon various surveys and overviews of personal habits, nothing has yet been devised to replace the hand toothbrush as the means most used for performing that hygienic function.

In terms of such widespread use of the hand-held toothbrush, many have attempted to practically automate its use by combining it structurally with a means for pumping toothpaste to the top of the bristles of the toothbrush, or moving toothpaste to a point where it can be deposited at the bottom of the bristles of the brush. Moricich Patent No. 2,562,937 is an example of a mechanism for dispensing the toothpaste at the bottom of the bristles, as is Kim, U.S. Pat. No. 4,615,635 and Fey U.S. Pat. No. 5,028,158. Fox Pat. No. 3,816,007 is an example of a mechanism mentioned above, which uses a complex reciprocal pump, with a pump-valve dispenser construction for moving the toothpaste tube to the use position at the top of the bristles of the toothbrush.

Furthermore, other U.S. patents detail constructions, which provide mechanisms and structures similar to those mentioned above, and/or provide other mechanisms and structures to automate the paste-applying and/or toothbrushing functions. For instance, Casselman in U.S. Pat. No. 3,549,268 uses a rotating, bottom-tube control handle for controlling toothpaste feed automatically.

As to all of the above, the structures presented and suggested are particularly complex, cumbersome and expensive with respect to the function performed, and particularly with respect to the consideration that children make up a large portion of the user population.

SUMMARY OF THE INVENTION

Accordingly, a primary object of the present invention is to provide a combination toothpaste housing, toothpaste feeding mechanism, and toothbrush, which is simple and yet efficient in the performance of such functions.

A further object of the present invention is to provide a structure which is inexpensive, comfortable and easy to use, and which satisfies the performance of toothbrushing, toothpaste housing and toothpaste feeding functions; and A further and additional object of the present invention is to combine multiple toothbrushing functions in a structure which is simple and yet comfortable for the user.

These and other objects of the present invention ar provided in a structure which features an elongated housing for toothpaste, with opening means defined at one of its ends for inserting a toothpaste tube, a second opening defined at the other of its ends to extend therethrough the mouth of the toothpaste tube for automatically applying toothpaste to the top of toothbrush bristles, a movably attached head of a toothbrush with respect to the second opening for the application of toothpaste onto the top of the bristles and for thereafter moving the bristles to a use position. A mechanism is provided to accomplish the motion of the toothpaste tube forwardly through and back into the second opening mentioned above. A collar engaging the neck of the toothpaste tube and an attached knob, or the like, is used to move the collar between a first and second position for purposes of this invention. Also, a slide, preferably operably connected to the collar, and a double rack and pinion is used to coordinate the movement of the toothbrush bristles between a paste-loading position and a use position with the collar motion. Additionally, the housing defines on its outer surface a gripping form in the shape of an undulating surface, or the like, for facilitating the gripping of the housing when applying the paste to the bristles and when using the bristles to brush. Still further, a mechanism is provided for squeezing the toothpaste from the mouth of the toothpaste tube onto the bristles.

BRIEF DESCRIPTION OF THE DRAWINGS

Other objects, features and advantages of the present invention will become apparent by the following, more detailed description of the preferred, but nonetheless, illustrative, embodiment, with reference to the accompanying drawings, wherein.

DETAILED DESCRIPTION OF THE PREFERRED AND ALTERNATIVE EMBODIMENTS

Figures 1, 4:
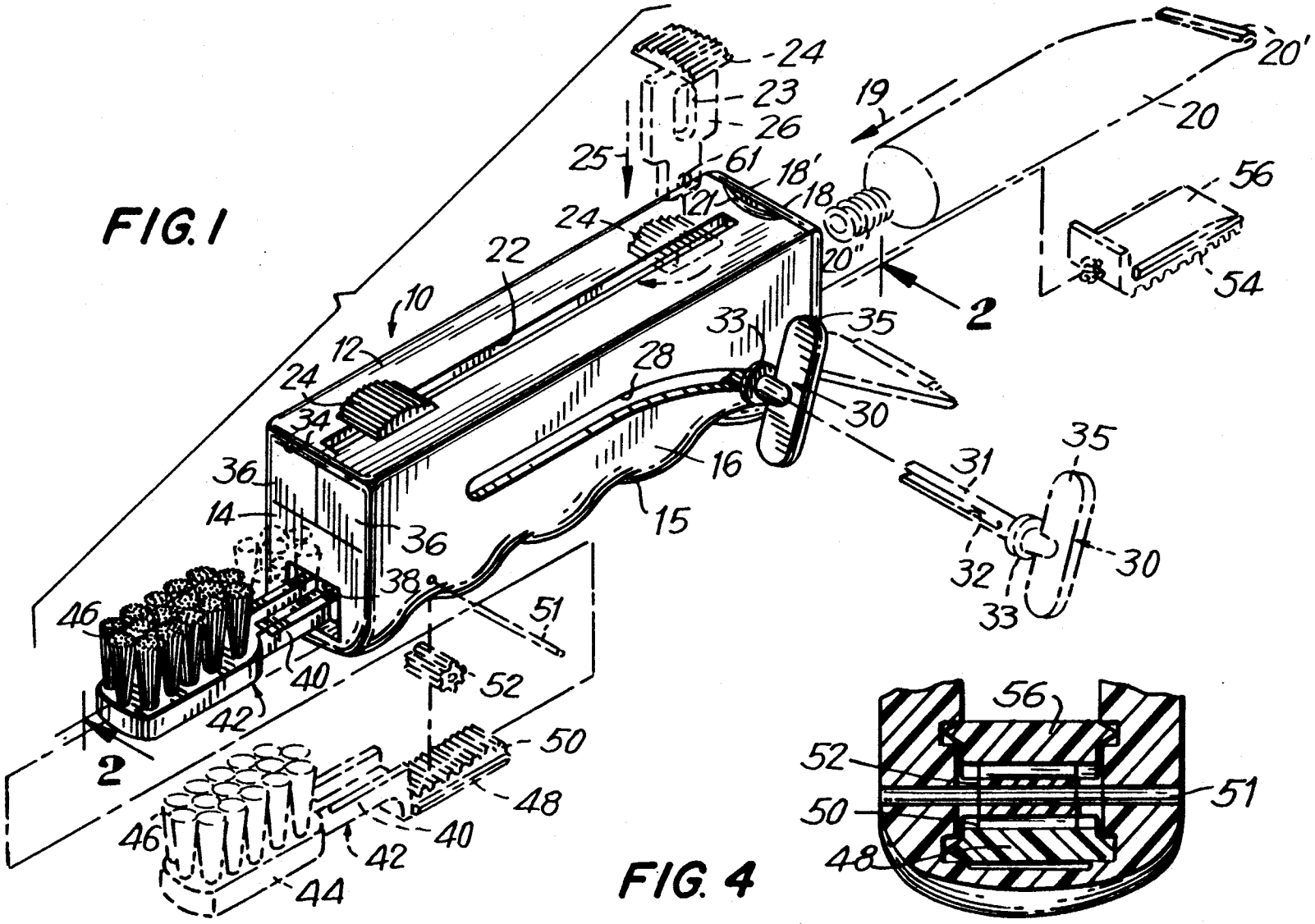
FIG. 1 is a front, right side and top isometric view of the present invention, showing particularly the loading mechanism, structure and procedure for the toothpaste tube, the collar, the connecting structure for the collar, the structure for providing movement to the brush bristles, and the squeezing mechanism.
FIG. 4 is a front sectional view taken along the line 4—4 of FIG. 3 and showing particularly the front view of the connecting and motion structure, as previously briefly described.

Referring to the drawings, and particularly FIG. 1 thereof, a structure according to the preferred embodiment of the present invention is shown, along with use and assembly representations.

The preferred embodiment structure includes a housing, generally designated 10, having a top wall 12, a front wall 14, a right side wall 16 and a back wall 18. The back wall 18 is structured to include a door 18', which opens to admit toothpaste tube 20, (shown in ghost lines) in direction 19, at the rear of housing 10. Thumb indentation 21 is defined by top wall 12 in order to facilitate the opening of door 18'.

Figures 2, 3:
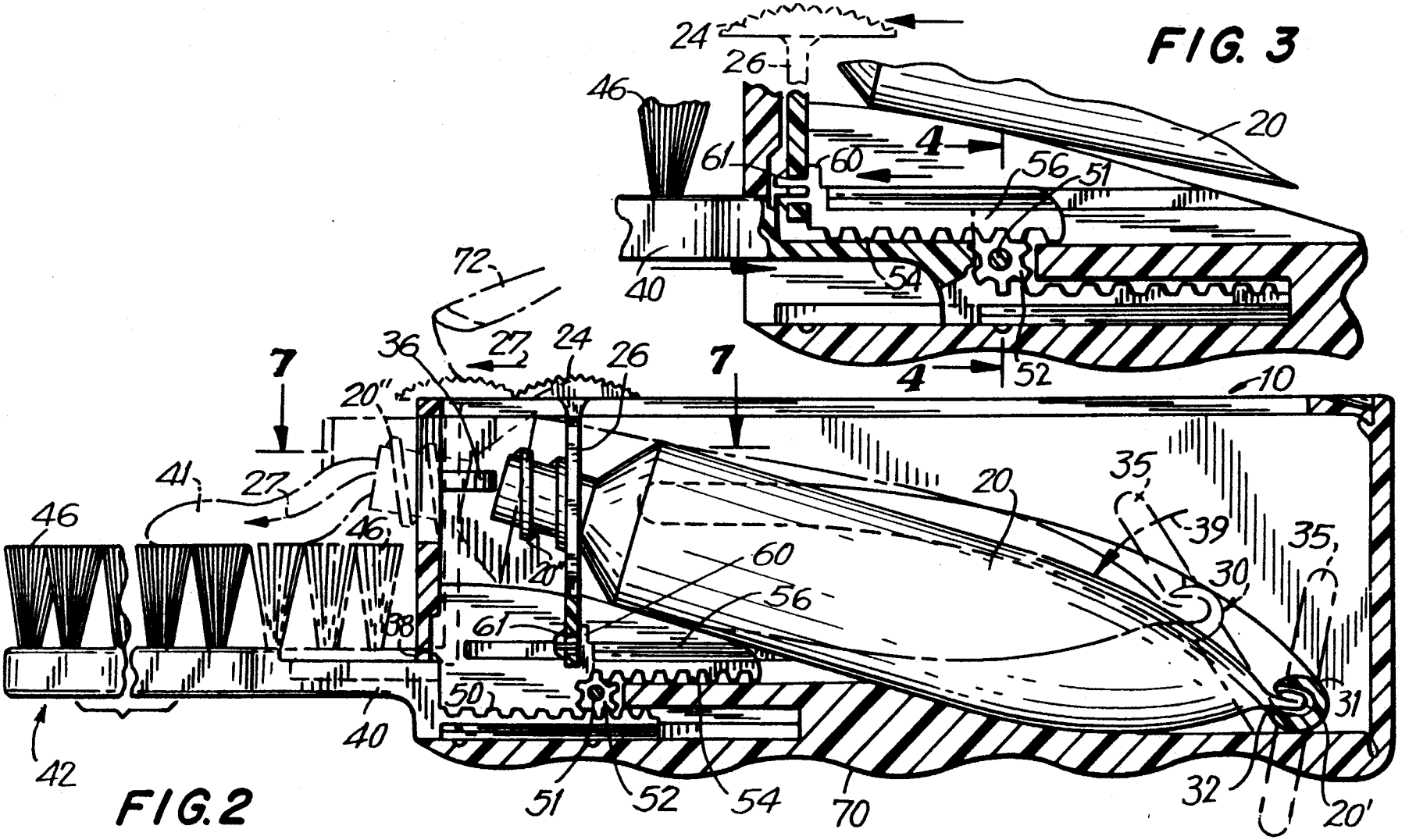
FIG. 2 is a sectional view, taken along the line 2—2 of FIG. 1 and showing particularly the motive capability of the squeezing structure, and the connecting structure for the collar and the structure for providing the motion to the bristles.
FIG. 3 is an enlarged view of the connecting structure and the motion structure, with respect to the collar and the structure for moving the bristles.
Figure 5:
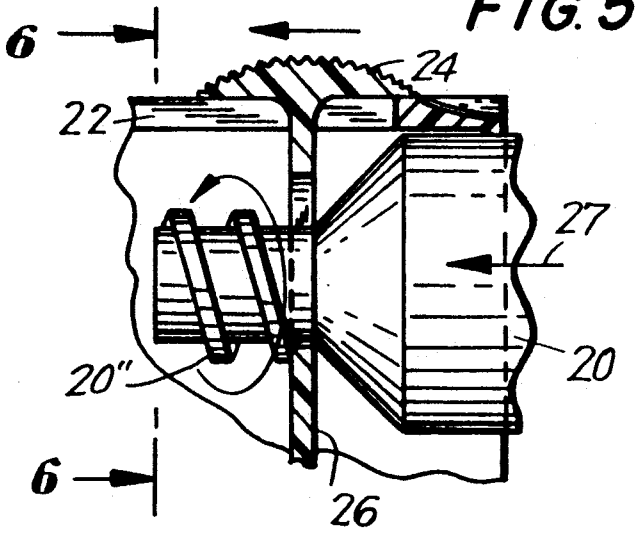
FIG. 5 is a partial, enlarged view of the toothpaste tube mouth and collar of the present invention, with attached knob or wheel.

Top wall 12 defines an elongated slot 22, for providing the track for knob or wheel 24, which is connected rigidly to collar 26 (also see FIGS. 2 and 5). Likewise, side wall 16 defines elongated slot 28 for tracking a squeezing mechanism and structure for toothpaste tube 20. More specifically, squeezing structure 30 is a knob 33 with extending wing surfaces 35, from which depends an elongated squeezing pin 31, defining elongated squeezing slot 32 for gripping the bottom end 20' of toothpaste tube 20.

Front end 14 of housing 10 defines a front opening 34, which is covered by front doors 36. Lower front opening 38, defined by front end 14, is to accommodate stem 40 of the toothbrush generally designated 42. Toothbrush 42 includes head 44, bristles 46 extending upwardly from head 44, stem 40, as previously described, and toothbrush base 48. Base 48, defines on its upwardly facing surface a plurality of ridges 50, essentially functioning as a gear surface (part of a rack and pinion type of structure).

Figure 6:
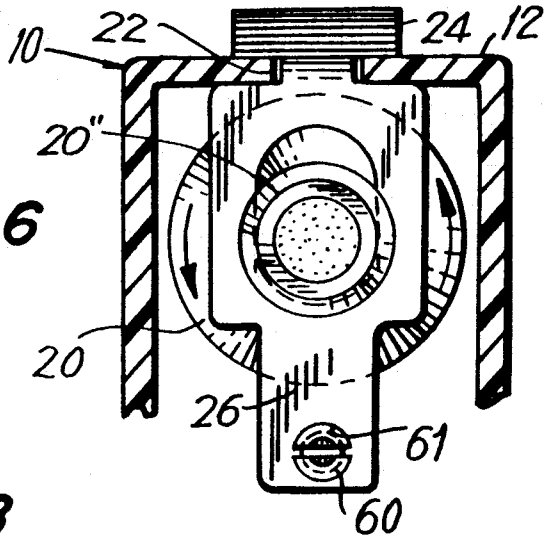
FIG. 6 is a front sectional view, taken along the line 6—6 of FIG. 5.

Gear surface 50 is intended for mating with gear wheel 52, which in turn is intended to mate with gear surface 54 shown in ghost lines near the rear of the housing in FIG. 1, as defined by front toothpaste tube support 56 (also see FIG. 4). Gear wheel 52 (the pinion) is intended to fit upon axis 51 (see FIGS. 2 and 3), between gear racks 54, 50, so that the forward motion in direction 27 (FIG. 5) of collar 26 causes the motion of toothbrush 42 rearwardly (with respect to the housing 10). Structurally, toothpaste tube support 56 has protruding from its forward end (see FIGS. 2 and 3) a connecting clip 60 for attachment through opening 61 defined at the lower end of collar 26 (see FIG. 6).

Figure 8:
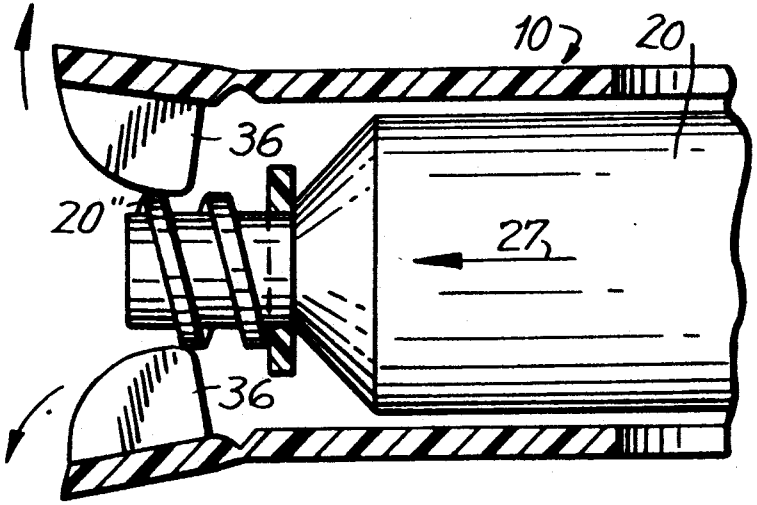
FIG. 8 is a view, similar to that of FIG. 7, but showing the mechanism for thrusting the mouth of the toothpaste tube through the second opening.
Figure 7:
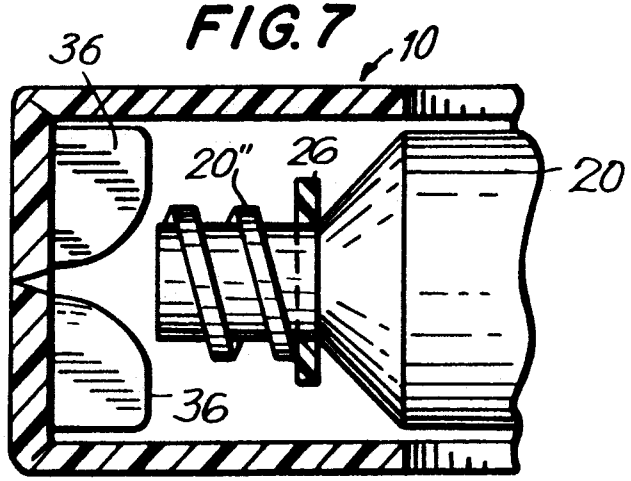
FIG. 7 is a top sectional view, taken along the line 7—7 of FIG. 2, and showing particularly the relationship of the mouth of the toothpaste tube with the second opening.

More specifically, doors 36 (FIGS. 1, 7 and 8) are provided at the front end of housing 10 and thickly shaped in a manner not to interfere during operation with the threads 20'' typically found at the open front end, extension nozzle or top end of a toothpaste tube. Thus, the rearwardly extending part of doors 36 (best shown in FIG. 2) performs as a camming surface to push doors 36 open, without interference with threads 20''.

Various alternative embodiments are contemplated for this invention. For instance, rather than the separate squeezing mechanism and structure previously described and the collar mechanism for moving the toothpaste tube in and out of the front of the housing, a combined mechanism and structure wherein a pair of gears or a single cylindrical gear depends onto tube 20 from a knurled knob travelling in slot 22, provides the squeezing and moving function all with a single mechanism, and without the use of winged knob 33. In other words, the weight and structure of the depending cylinder or gears of the alternative embodiment pushes tube 20 downwardly against a supporting platform (not shown).

Likewise, a tube squeezer is provided rearwardly of housing 10 for twisting toothpaste tube 20 from its bottom in order to feed the toothpaste.

Similarly head 44 of toothbrush 42 is enlarged so that the toothbrush is placed into position below the front opening of toothpaste tube 20 for loading u bristles 46 with toothpaste and then manually pulled in direction 27 prior to the brushing operation. The enlarged head of this alternative embodiment is sufficient to accommodate the thumb and forefinger of the user, without the necessity for touching bristles 46, for hygienic reasons. Also in this regard, stem 40 of toothbrush 42 defines a protrusion to mate in two different positions with indentations defined by housing 10 in the area now occupied by lower rack or gear 50 and base 48. In other words, rack 50 and the entire double rack and pinion structure would not then be necessary in view of the manual operation of the alternative embodiment, to be coordinated by the user with the operation of knurled knob 24.

The immediately foregoing description of an alternative embodiment, for manual in-out motion of toothbrush 42 is usable with or without a further alternative relating to bifurcated stem 40, whereby the bristles 46 are manually turned upwardly for paste-loading and downwardly for brushing in order to avoid the interference or obstruction by housing 10, during the brushing process, with the mouth of the user. Specifically, the bifurcated stem involves the tight-fitting mating of a forward part of stem 40, with a rearward part of stem 40, lockable in two positions, upwardly and downwardly, by the user, with a single protrusion and a pair of indentations (or vice-versa). This alternative serves the function of cutting down the length of stem 40, whose long length (about two inches) is recommended for the preferred embodiment in order to avoid interference or obstruction by housing 10 with the user's mouth.

In all embodiments, a gripping surface 70 is defined by housing 10 on one or more of the side surfaces, in order to accommodate the user's grip during any of the manual operations indicated, and/or during the brushing operation. For instance, bottom wall 15 accommodates four fingers.-and top wall 12 defines a gripping surface to accommodate the thumb; or any other variation of gripping surface is provided.

Lastly, in order to provide a description of more of the alternatives indicated by the present invention, but all within the claims hereof, a cap (not shown) is provided for the mouth or front opening of toothpaste tube 20. For further hygienic protection, such cap (usually being provided by the toothpaste manufacturer) is designed with a flip-top cap or a threaded cap, or an extended nozzle opening.

In order to provide a more detailed and even clearer description of the present invention, a series of use and assembly steps are now provided. In typical fashion, a right-handed user grips housing 10, with his thumb on top wall 12 and with the four fingers of his left hand on lower wall 15. The right hand is then used to thrust collar 26 in direction 25 (FIG. 1) through slot 22, and to twist collar 26 (and attached knurled knob 24) ninety degrees. Tube 20 is then grasped by the same right hand so that its threaded neck 20'' is placed through the upper large opening 23 of collar 26. Rack 54, 56, with forward protrusion 60 is placed through opening 61 defined by collar 26, so that it moves with the collar toward the front of housing 10. Knurled knob 24, by manipulation of the user's thumb, carries tube 20, lodged in collar 26 forwardly of housing 10. When tube 20 is wholly within housing 10, knob 33 is manipulated by the user's right hand to grasp bottom end 20' of tube 20, thus to enable the rolling, counter-clockwise, squeezing motion for wings 35.

The user's own brush and stem structure (shown in ghost lines below FIG. 1) is thrust into opening 38 at the front of housing 10, so that rack 48, 50 meshes below pinion 52. As shown most clearly in FIG. 2, this thrusting, by the use of mechanical stops and the like (not shown), leaves approximately a two inch stem 40 protruding to hold the bristles 46 facing upwardly. When ready for brushing, user's thumb 72 rolls knob 24 forwardly, in direction 27 to carry the toothpaste tube forwardly, as shown by ghost lines in FIG. 2. Of course, simultaneously, the double rack and pinion mechanism carries stem 40 rearwardly, so that bristles, 46 move to a position shown by ghost lines in FIG. 2, just below the opening defined by threaded nozzle or neck 20" of tube 20. If necessary, the user's right hand is then used to gently squeeze the bottom of tube 20, by rotating wings 35 in a counter-clockwise direction 39 with the user's right hand (see FIG. 2—ghost lines).

Following the flow of toothpaste 41 (FIG. 2) onto bristles 46, knob 24 is moved rearwardly of housing 10, in a direction opposite to the direction of arrow 27, in order to move the toothpaste tube back into housing 10, and simultaneously, the bristles 46 and stem 40 forwardly of housing 10. This provides a full extension of bristles 46 away from the front of the housing in order to perform the brushing operation.

Therefore, the foregoing provides preferred, illustrative and alternative embodiments, but the limit of the invention herein is to be provided only by the following claims:

What is claimed is:

1. A combined toothbrush and toothpaste holding and feeding structure for use in applying paste from a toothpaste tube, including a nozzle, an opening defined by said nozzle and a tube bottom, onto a user's toothbrush bristles, comprising an elongated housing having a first end, a second end, and defining at said first end an opening for loading said toothpaste tube into said housing with its nozzle being loaded initially before its bottom, means for advancing said nozzle toward said second end, means for squeezing said tube bottom, said means for advancing providing a first position for said nozzle within said housing and a second position for said nozzle opening outside of said second end, a toothbrush with bristles and a stem, insertable to said housing through said second end, and means for positioning said bristles below said nozzle opening when said nozzle opening is in said second position, all adapted and arranged to load said toothpaste tube into said housing, to squeeze toothpaste from said toothpaste tube, when said toothpaste tube nozzle opening is positioned above said bristles and to brush the user's teeth, while remaining during said functioning as a unitary, combined structure.

2. The invention according to claim 1, wherein said means for advancing includes a collar defining main and secondary openings therein, a knurled knob attached to said collar and said housing includes a top wall defining an elongated slot therein, said collar being insertable to said slot and rotatable therein with said knob, whereby said nozzle is movable into said main opening.

3. The invention according to claim 2, wherein said means for squeezing includes a knob, an elongated squeezing pin extending from said knob in a direction perpendicular to said slot, said pin defining a squeezing slot for gripping the bottom end of said tube and said housing having a side wall which defines an elongated slot extending generally from said first end to said second end, with said pin movable toward said second end in said side wall slot as said toothpaste tube is depleted.

4. The invention according to claim 2, wherein said toothbrush also includes a base portion at the opposite end of said stem from said bristles, said means for advancing further includes a toothpaste tube support, extending forwardly of which is a means for connecting said support to said collar, and a pinion, which rotates between said base portion and said support to provide a double rack and pinion mechanism connecting the motion of said collar and said stem, said base portion and said support each defining gear teeth surfaces.

5. The invention according to claim 1, wherein said means for advancing includes a knurled knob, a top wall for said housing defining an elongated slot in which said knob moves, a bottom structure depending from said knob for moving with said tube from said first end to said second end and said means for squeezing includes a squeezing structure connected to said tube bottom.

6. The invention according to claim 1, wherein said means for positioning includes an enlarged toothbrush head for providing a manual gripping surface.

7. The invention according to claim 1, wherein a door is provided to cover said first end opening.

8. The invention according to claim 1, wherein a door is provided at said second end between said first position and said second position.

9. The invention according to claim 1, wherein said housing includes a plurality of side walls, a multiplicity of which define an outside gripping surface, in the form of finger indentations and a thumb indentation.

10. The invention according to claim 1, wherein said housing includes a plurality of side walls, one of which defines an outside gripping surface, in the form of finger indentations.

* * * * *